United States Patent [19]

Butterwick

[11] 4,439,712

[45] Mar. 27, 1984

[54] ANODE STRUCTURE FOR PHOTOMULTIPLIER TUBE

[75] Inventor: Gilbert N. Butterwick, Leola, Pa.

[73] Assignee: RCA Corporation, New York, N.Y.

[21] Appl. No.: 296,527

[22] Filed: Aug. 26, 1981

[51] Int. Cl.[3] ..... H01J 43/00

[52] U.S. Cl. ..... 313/533; 313/105 R

[58] Field of Search ..... 313/95, 103 R, 104, 313/105 R; 315/5.38

[56] References Cited

U.S. PATENT DOCUMENTS

| | | | |
|---|---|---|---|
| 1,871,280 | 8/1932 | Rentschler | 313/101 |
| 1,942,165 | 1/1934 | Geffcken et al. | 313/102 |
| 2,084,865 | 6/1937 | Penning et al. | 313/98 |
| 2,285,126 | 6/1942 | Rajchman et al. | 313/105 R |
| 2,818,520 | 12/1957 | Engstrom et al. | 313/95 |
| 2,868,994 | 1/1959 | Anderson | 250/207 |
| 3,238,406 | 3/1966 | Greilich et al. | 313/94 |
| 3,260,878 | 7/1966 | Legoux | 313/104 |
| 4,002,735 | 1/1977 | McDonie et al. | 427/78 |

OTHER PUBLICATIONS

RCA Technical Note, 270, R. W. Engstrom et al., "Plate Anode for Phototubes", Jun. 1959.

*Primary Examiner*—Palmer C. Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An improved electron multiplier assembly includes a plurality of communicating electrodes affixed to a pair of insulative support plates. The electrodes comprise a plurality of dynodes including an ultimate dynode and an anode. The anode comprises a substantially flat, rigid member having at least one longitudinally-extending aperture. The anode is disposed substantially within and spaced from the ultimate dynode. Mounting tabs extend from the anode to inflexibly secure the anode to the support plates.

9 Claims, 5 Drawing Figures

ANODE STRUCTURE FOR PHOTOMULTIPLIER TUBE

BACKGROUND OF THE INVENTION

The invention relates to an electron multiplier assembly such as that used in a photomultiplier tube, and particularly to an anode member for an electron multiplier assembly that is resistant to electrical shorts.

The growing demand for petroleum products has placed increasing emphasis upon the need for improved oil exploration techniques. As the supply of easily obtainable oil dwindles, exploration has had to move to more remote geographical areas and to deeper fields. One technique for accurately determining the location, size and yield of an oil field is by oil-well logging. Logging is a term given to the method of determining the mineral composition and structure of the geological media along very deep holes. Sensitive probes, or sondes, are used to determine the lithology, i.e., the character of the rock formation, including the density of the media along the bore hole. The bole holes are typically thousands of feet deep and may extend to about twenty thousand feet. Temperature increases with bore hole depth and the temperature in a twenty thousand feet deep hole may range between 100 ° to 250° C. In logging such a hostile environment, the sondes, which include a radioactive gamma ray source such as cesium 137 and a detector comprising a sodium iodide crystal and a photomultiplier tube, are subjected to shock and vibration in addition to high operating temperatures.

Photomultiplier tubes used for oil-well logging are preferably small and rugged. The RCA C33016G photomultiplier tube has a 25.4 mm diameter and a length of about 60 mm. It is well known in the art that the deleterious effects of shock and vibrations can be minimized by using stiff, short support leads, extending through the base of the tube and connected directly to the active tube elements such as the anode and the dynodes, to resist and quickly damp vibrations. However, the stiff support leads expand as the sondes are lowered into the bore hole and the temperature increases. This thermal expansion causes flexing of the tube elements which may result in electrical shorts. In the RCA C33016G tube, the spacing between the anode and the ultimate dynode is about 0.1 mm (0.004 inch). Such close spacing is required in order to provide fast and efficient anode response characteristics. As shown in FIG. 5, a conventional anode, A, is disposed within the substantially elliptically-shaped ultimate dynode, $D_N$. Despite the fact that the longitudinally-extending edges of the anode are curled to stiffen the structure, electrical shorts caused by environmentally-induced anode movement frequently occur between the ultimate dynode and the anode.

A somewhat more rigid type of anode structure in which the anode member comprises a thin, solid, flat plate disposed substantially parallel to and just outside of the main path of the electron flow from the penultimate dynode to the ultimate dynode is shown in U.S. Pat. No. 2,868,994 issued to Anderson on Jan. 13, 1959. In the Anderson patent, the anode does not intercept electrons traveling in the main path; however, the anode presents a favorably large surface to the cylindrically-shaped ultimate dynode which is so curved that the secondary electrons emitted therefrom are focused onto the anode. Furthermore, the solid flat plate prevents electron orbiting or oscillation which commonly occurs with rod-like and grid-type anodes. Unfortunately, the anode structure of the Anderson patent is impractical for use in small electron multipliers, such as that used in the RCA C33016G, since the elliptically-shaped ultimate dynode, dictated by the size constraints and environmental requirements of a small tube, has a limited opening for electrons from the penultimate dynode and the Anderson anode would intercept an unacceptably large percentage of the electron flow to the ultimate dynode. Scaling down the dimensions of the Anderson anode to increase the electron flow to the ultimate dynode would weaken the anode thereby increasing the possibility of anode shorts. Additionally, an anode structure, such as the Anderson anode, which is disposed substantially parallel to the main path of the electron flow and extends beyond the ultimate dynode, creates the possibility of an electrical short between the anode and the penultimate dynode.

A conventional anode structure, such as a grid-type anode comprising a pair of parallel support rods having a fine wire mesh wound thereon, is shown in U.S. Pat. No. 4,002,735 to McDonie et al., issued on Jan. 11, 1977. The grid-type anode is unacceptable for use in a small electron multplier subjected to hostile environments since in addition to the electron oscillation problem common in grid-type anodes, wire wound anodes frequently develop electrical shorts to the ultimate dynode because of broken mesh wires, or mesh wire sag caused by flexing of the support rods induced by thermal changes in the anode support lead which is connected to the support rods.

SUMMARY OF THE INVENTION

An improved electron multiplier assembly of the type having insulative support means includes a plurality of communicating electrodes affixed to the support means. The electrodes comprise a plurality of dynodes including an ultimate dynode and an anode. The anode is disposed substantially within and spaced from the ultimate dynode. The anode comprises a substantially flat, rigid member having at least one longitudinally-extending aperture formed therein. Mounting means extend from the member for inflexibly securing the member to the support means.

DETAILED DESCRIPTION OF THE PREFERRED EMBODIMENT

Figure 1:
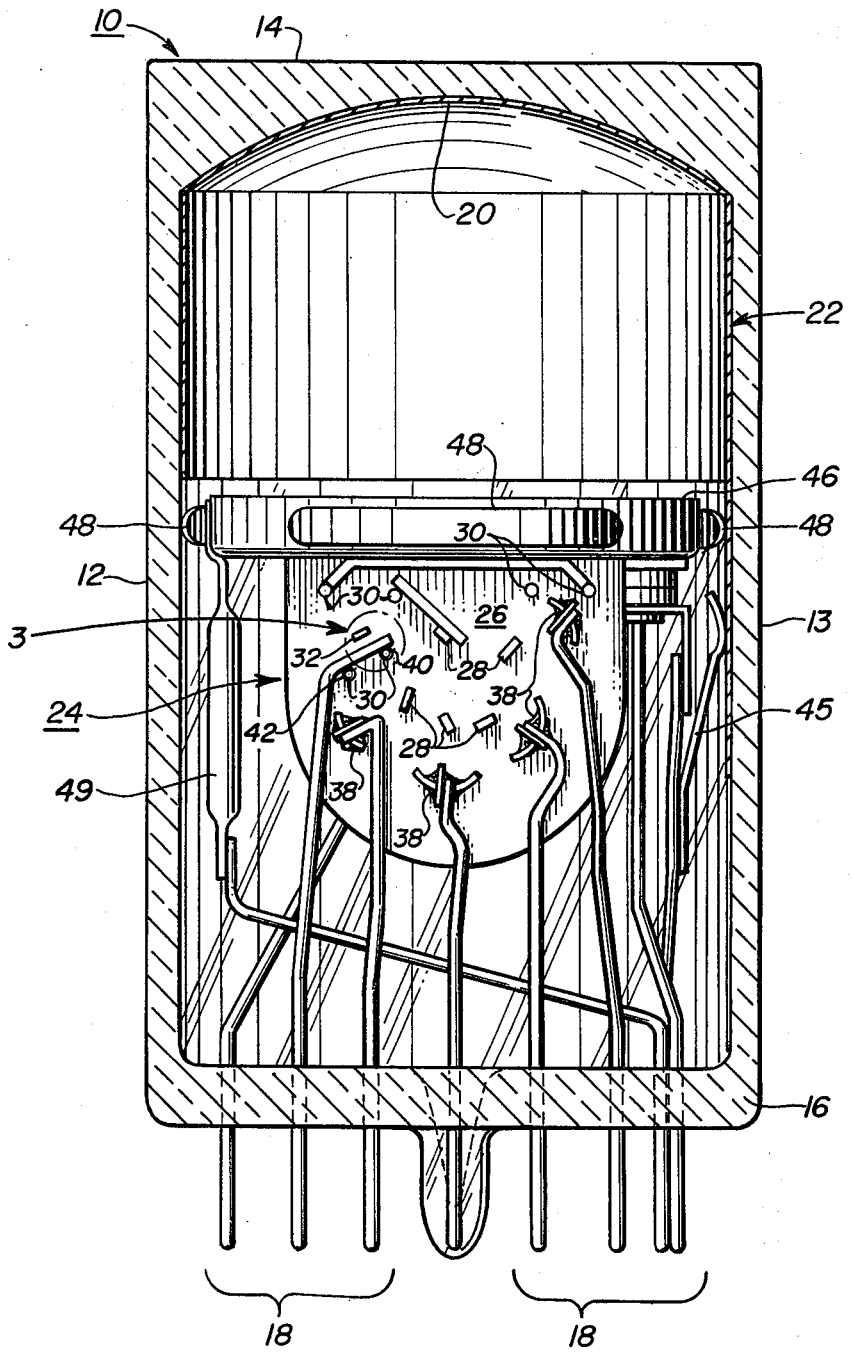
FIG. 1 is an enlarged sectional elevational view of a device including an electron mutliplier assembly embodying the present novel structure.

Referring to the drawings, there is shown in FIG. 1 a photomultiplier tube 10 comprising an evacuated envelope 12 having a generally cylindrical sidewall 13, a transparent faceplate 14 and a stem 16, through which a plurality of relatively stiff conductive cage assembly support leads 18 are vacuum sealed. The leads 18 are three-piece leads with a central Kovar postion sealed to the stem and stainless steel end portions. A photocathode 20 is formed on an interior surface of the faceplate 14. An aluminum coating 22 is deposited on the upper inner surface of the envelope 12. The coating 22 makes electrical contact with the photocathode 20.

Figure 2:
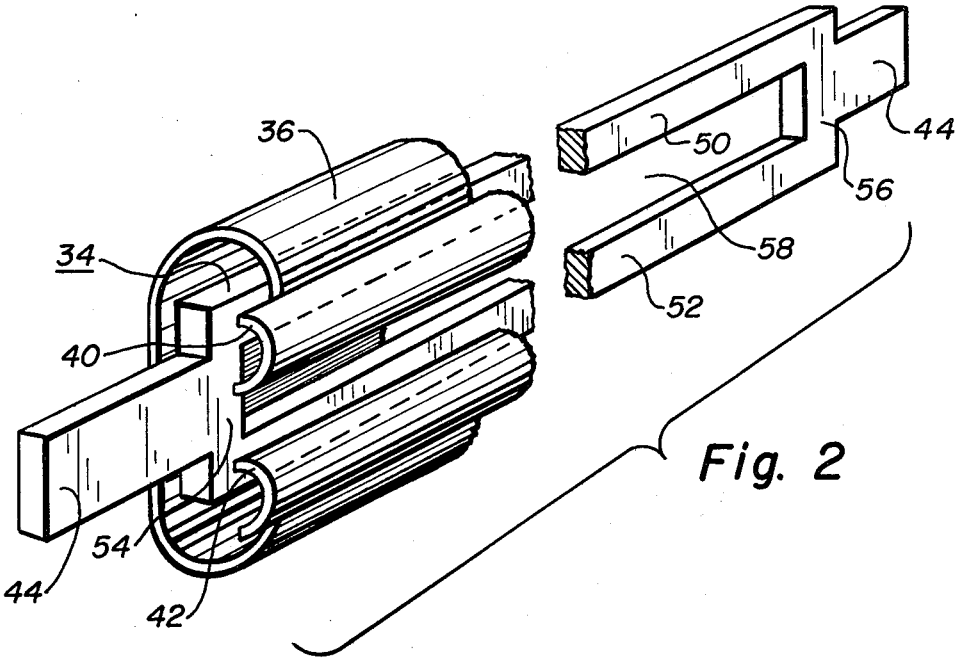
FIG. 2 is an enlarged perspective view of an ultimate dynode having a novel anode member disposed therein.
Figure 3:
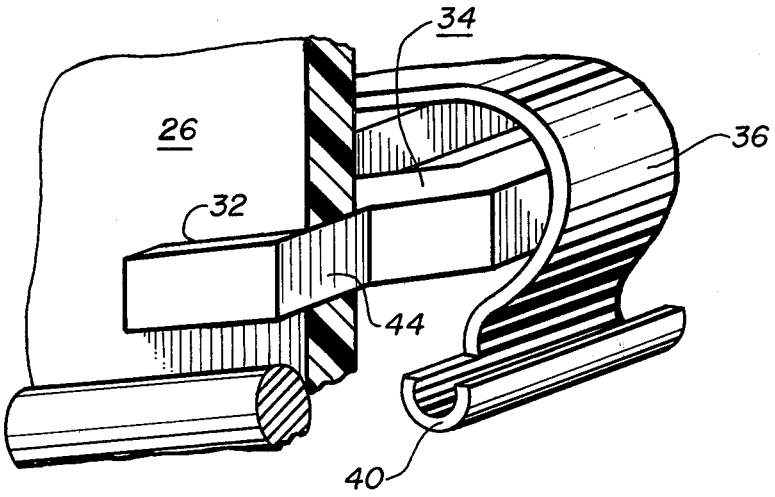
FIG. 3 is an enlarged partially cut-away perspective view of the area within circle 3 in FIG. 1 showing an anode mounting tab disposed within a support spacer aperture.
Figure 4:
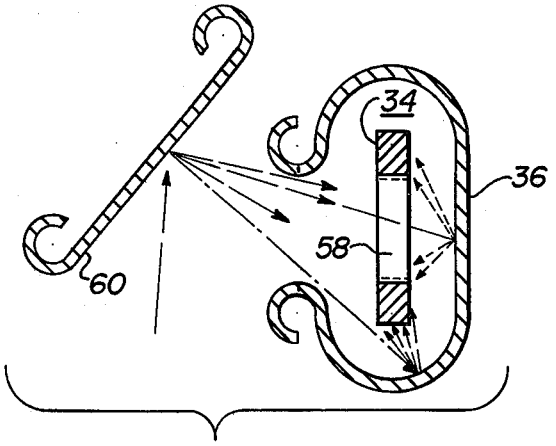
FIG. 4 is an enlarged sectional elevational view showing the spatial relationship of a penultimate dynode, an ultimate dynode and a novel anode member.

A cage assembly or electron multiplier assembly, indicated generally as 24, is supported within the envelope 12 preferably by a pair of spaced substantially parallel insulative dynode support spacers 26 (only one of which is shown). The dynode support spacers 26 are preferably formed from a ceramic material; although, any equivalent material may be used. Each of the dynode support spacers 26 has a plurality of electrode apertures comprising elongated dynode support apertures 28 and small circular support apertures 30 extending therethrough. A substantially rectangular anode support aperture 32 is formed in each of the support spacers 26. The cage assembly 24 includes a plurality of closely-spaced dynodes arranged in a circular configuration well known in the art and shown, for example, in U.S. Pat. No. 2,818,520 to R. W. Engstrom et al, issued on Dec. 31, 1957 and incorporated herein for disclosure purposes. The tube 10 is a ten-stage photomultiplier tube having ten dynodes and an anode. The anode member 34, shown in FIGS. 2–4, is substantially symmetrically enclosed within the last or penultimate dynode 36 of the cage assembly 24. Each of the dynodes with the exception of the last dynode 36 has a pair of oppositely disposed tabs 38 projecting from the ends thereof. For clarity, only four of the tabs 38 are shown in FIG. 1. The tabs 38 are electrically connected, i.e. by welding, to the stem leads 18. The remaining five tabs which are also electrically connected to the stem leads 18 extend from the opposite side of the cage assembly 24 (not shown). The dynode tabs 38 have a slightly cylindrical shape and are formed, for example by crimping, to provide a substantially flat welding surface. Crimping of the tabs 38 also serves to lock the dynodes within the spacers 26. The last dynode 36 is supported upon two support curls 40 and 42 formed in the ends of the dynode 36. The support curls 40 and 42 project from two of the support apertures 30 in support spacers 26. The anode member 34 includes a pair of oppositely-disposed mounting tabs 44 extending longitudinally from the ends thereof. The mounting tabs 44 are securely disposed within the anode support apertures 32 of the dynode support spacers 26. Electrical connection to the tube electrodes comprising the photocathode 20, the dynodes and the anode 34 is provided by welding a different one of the support leads 18 to the tab and curl ends of each of the tube electrodes. A spring contact 45 provides electrical contact between one of the support leads 18 and the aluminum coating 22 which is in contact with the photocathode 20.

A shield cup 46 having an aperture (not shown) is placed intermediate the photocathode 20 and the cage assembly 24 which is attached to the shield cup. The shield cup 46 is maintained at a potential positive with respect to the photocathode 20 to enhance the collection and focusing of the photoelectrons emitted by the cathode 20 in response to radiation incident thereon. A plurality of bulb spacers 48 are disposed circumferentially around the shield cup 46 to center the shield cup and the attached cage assembly 24. Within the shield cup 46 is an antimony source (not shown) which is used in conjunction with at least one alkali metal vapor source 49 to form the photocathode 20 and to activate the dynodes. While only one alkali metal vapor source is shown, two sources, one providing sodium vapor and the other providing potassium vapor are preferred to form a high temperature, stable, sodium-potassium-antimony photocathode 20.

The novel anode 34 is formed by a photo etching process well known in the art and described in U.S. Patent Application Ser. No. 145,237 filed by D'Amato, on Apr. 30, 1980 and now U.S. Pat. No. 4,318,026 issued on Mar. 2, 1982, entitled, "METHOD OF MAKING A GRID FOR A CATHODE-RAY TUBE ELECTRON GUN" , and incorporated by reference herein for disclosure purpose. In order to form the present anode member, a sheet about 0.15 mm thick of stainless steel is coated on both sides with a positive photoresist. Stainless steel is preferred because of its low secondary emission characteristics and its weldability to the stainless steel support leads 18. A pair of photomaster plates having opaque elements in the outline of the desired anode are placed in contact with each side of the photoresist coated sheet and exposed by a pair of light sources. The photoresist coatings are developed and removed from the exposed areas. The unexposed area contains a photoresist outline of the desired anode. The sheet is acid etched to form the anode. As shown in FIG. 2, the anode 34 is a substantially flat, rigid rectangular member having a pair of longitudinally-extending sides 50 and 52 which terminate in lateral end portions 54 and 56. The mounting tabs 44 extend longitudinally from the end portions 54 and 56. The open area circumscribed by the sides 50, 52 which terminate in lateral end portions 54 and 56. The mounting tabs 44 extend longitudinally from the end portions 54 and 56. The open area circumscribed by the sides 50, 52 and the end portions 54, 56 defines a longitudinally-extending anode aperture 58. In the preferred structure only a single longitudinally-extending aperture 58 is provided in order to maximize both the rigidity of the anode 34 and the transmission through the anode as described hereinafter. It should, however, be clear to one skilled in the art that rigidity can be increased with a reduction in transmission by providing longitudinal and/or lateral supporting elements, i.e., by creating a plurality of apertures. As shown in FIG. 2, the anode 34 has an active region, defined as the region extending between the mounting tabs 44, about 10.67 mm long and 1.78 mm wide with a rectangular aperture about 8.64 mm long and 1.17 mm wide formed therein. Each of the tabs 44 are about 1.04 mm wide and 0.15 mm thick. The tabs 44 provide an interference fit with the dynode support spacers 26 circumscribing the anode support apertures 32 so that any force, e.g., from thermal or mechanical forces acting on the support lead 18 attached to one of the tab ends 44, cannot cause a change in the spacing between the active region of the anode 34 and the ultimate dynode 36. In other words, the close spacing provided by the interference fit of the anode tab ends 44 within the anode support aperture 32 prevents the transmittal of an environmentally-generated bending force to the anode 34. Thus the tab ends 44 of the anode 34 are inflexibly secured within the anode support apertures 32.

Figure 5:
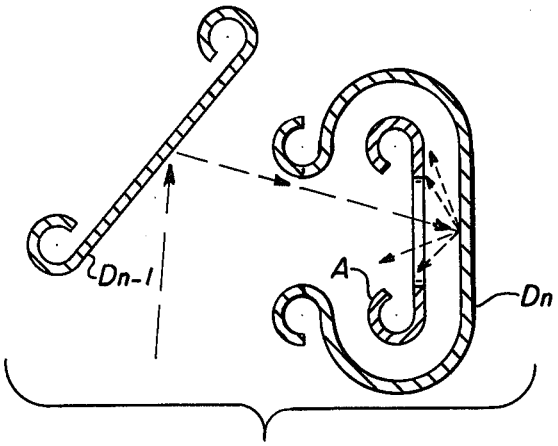
Fig. 5 PRIOR ART
FIG. 5 is an enlarged sectional elevational view showing the spatial relationship of a penultimate dynode, an ultimate dynode and a prior art anode member.

In the operation of the tube, increasingly positive potentials are applied to the photocathode 20, and to each of the dynodes and the anode 34. Typically, each dynode is about 100 volts more positive than the preceding dynode, and the anode 34 is about 100 volts more positive than the ultimate dynode 36. Initially, radiation incident on the photocathode 20 produces photoelectrons which are focused by the potential on the aluminum coating 22 and the shield cup 48 and pass through the shield cup aperture onto the primary dynode (not shown) of the cage assembly 24. The impringing photoelectrons produce a number of secondary electrons which, in turn, are propagated and concatenated along the communicating chain of dynodes to the anode. The path of a typical secondary electron is shown by the dashed line of FIG. 4. The secondary electron strikes the penultimate dynode 60 and produces a number of secondary electrons. The path of one secondary electron through the anode aperture 58 is shown. The secondary electron passing through the anode aperture strikes the ultimate dynode 36 which produces a number of secondary electrons that are attracted to and collected by the anode 34. In the present structure, substantially all of the secondary electrons from the penultimate dynode 50 pass through the anode aperture 58 and impinge upon the ultimate dynode 36. The novel anode 34, formed as described above, is about 50 percent thicker than the conventional anode, A, shown in FIG. 5. Nevertheless, the aperture 58 in the novel anode 34 is the same size as the aperture in the conventional anode, A, so the transmission through the aperture is unchanged. In order to make the conventional anode, A, sufficiently rigid, the longitudinal edges are curled to a nominal diameter of about 0.51 mm; however, the curls reduce the spacing between the anode, A, and the ultimate dynode, $D_N$, and thereby increase the possibility of anode electrical shorts. The novel anode structure 34 increases the spacing between the anode 34 and the ultimate dynode 36 from the conventional spacing of about 0.10 mm to about 0.15 mm at the point of closest approach while providing a thicker and stronger anode member with the same electron transmission as a conventional anode. The collection efficiency of the novel anode 34 is greater than that of the conventional anode, A, since elimination of the curls on the novel anode permits the lateral anode dimension of the novel anode 34 to be reduced from about 2.18 mm on the conventional anode to 1.78 mm. Thus, electrons leaving the penultimate dynode 60 with an angular distribution shown by the dash-dot line of FIG. 4 will avoid initially impacting with the anode 34 but will first strike the ultimate dynode 36 before being collected by the anode. The novel anode 34 therefore permits more of the electrons from the penultimate dynode 60 to reach the ultimate dynode 36 and take part in the multiplication process.

What is claimed is:

1. In an electron multiplier assembly comprising, insulative support means having a plurality of support apertures therethrough, a plurality of communicating dynodes affixed to said support means, said dynodes including a penultimate dynode and an ultimate dynode, and an anode disposed substantially within and spaced from said ultimate dynode, the improvement wherein said anode comprises, a substantially flat, rigid rectangular member having a longitudinally-extending aperture formed therein, said aperture being directed substantially toward said penultimate dynode, said anode member having mounting means extending from the ends thereof for inflexibly securing said anode within said support apertures of said support means.

2. In an electron discharge device comprising a plurality of elements within an evacuated envelope, said elements including a source of electrons, an anode spaced from said source, at least two dynodes including a penultimate dynode and an ultimate dynode for propagating and concatenating electrons from said source to said anode, said anode being disposed within and spaced from said ultimate dynode, insulative support means having a plurality of support apertures therethrough for supporting said dynodes and said anode, and electrode means for energizing said elements, the improvement wherein said anode comprises, a substantially flat, rigid rectangular member having a longitudinally-extending anode aperture formed therein, said aperture being directed substantially toward said penultimate dynode so that substantially all electron emission from said penultimate dynode passes through said anode aperture before striking said ultimate dynode, said anode member having mounting means extending longitudinally from the ends thereof for inflexibly securing said anode within said support apertures of said support means.

3. The device as in claim 2, wherein said mounting means comprises mounting tabs.

4. The device as in claim 3, wherein said mounting tabs provide an interference fit with the insulative support means circumscribing said support apertures.

5. The device as in claim 4, wherein said anode member comprises stainless steel.

6, The device as in claim 5, wherein said anode member has a thickness of about 0.15 mm.

7. In an electron discharge device comprising a plurality of elements within an evacuated envelope, said elements including a source of electrons, an anode spaced from said source, at least two dynodes including a penultimate dynode and an ultimate dynode for propagating and concatenating electrons from said source to said anode, said anode being disposed within and spaced from said ultimate dynode, insulative support means having a plurality of support apertures therethrough for supporting said dynodes and said anode, and electrode means for energizing said elements, the improvement wherein said anode comprises, a substantially flat, rigid rectangular member having a longitudinally-extending anode aperture formed therein, said aperture being directed substantially toward said penultimate dynode so that substantially all electron emission from said penultimate dynode passes through said anode aperture before striking said ultimate dynode, said anode member having mounting tabs extending longitudinally from the ends thereof to provide an interference fit with the insulative support means circumscribing said support apertures and to flexibly secure said anode within said support apertures.

8. The device as in claim 7, wherein said anode member comprises stainless steel.

9. The device as in claim 8, wherein said anode member has a thickness of about 0.15 mm.

* * * * *

UNITED STATES PATENT AND TRADEMARK OFFICE

CERTIFICATE OF CORRECTION

PATENT NO. : 4,439,712

DATED : March 27, 1984

INVENTOR(S) : Gilbert Nason Butterwick

It is certified that error appears in the above-identified patent and that said Letters Patent is hereby corrected as shown below:

Column 4, Lines 34-37 - delete the following, "The open area circumscribed by the sides 50, 52 which terminate in lateral end portions 54 and 56. The mounting tabs 44 extend longitudinally from the end portions 54 and 56.".

Signed and Sealed this

*Ninth* Day of *October 1984*

[SEAL]

*Attest:*

*Attesting Officer*

GERALD J. MOSSINGHOFF

*Commissioner of Patents and Trademarks*